US009661897B2

(12) United States Patent
Thompson

(10) Patent No.: US 9,661,897 B2
(45) Date of Patent: May 30, 2017

(54) COWBOY BOOTS WITH INTERCHANGEABLE INLAY FOR THE PURPOSE OF CHANGING COLORS OF DESIGN

(71) Applicant: DUSTY ROCKER BOOTS LLC, Wichita Falls, TX (US)

(72) Inventor: Leslie Thompson, Wichita Falls, TX (US)

(73) Assignee: Dusty Rocker Boots, LLC, Wichita Falls, TX (US)

( * ) Notice: Subject to any disclaimer, the term of this patent is extended or adjusted under 35 U.S.C. 154(b) by 227 days.

(21) Appl. No.: 14/057,772

(22) Filed: Oct. 18, 2013

(65) Prior Publication Data

US 2014/0109442 A1 Apr. 24, 2014

Related U.S. Application Data

(60) Provisional application No. 61/715,721, filed on Oct. 18, 2012.

(51) Int. Cl.

| | |
|---|---|
| ***A43B 23/24*** | (2006.01) |
| ***A43B 3/00*** | (2006.01) |
| ***A43B 3/24*** | (2006.01) |
| ***A43B 1/00*** | (2006.01) |
| ***A43B 3/02*** | (2006.01) |

(52) U.S. Cl.

CPC ..... *A43B 23/24* (2013.01); *A43B 1/0027* (2013.01); *A43B 3/0031* (2013.01); *A43B 3/0078* (2013.01); *A43B 3/02* (2013.01); *A43B 3/242* (2013.01); *A43B 1/0081* (2013.01)

(58) Field of Classification Search

CPC ... A43B 1/0072; A43B 1/0078; A43B 3/0031; A43B 3/242; A43B 23/24

USPC ..... 36/136, 1.5, 100, 45

See application file for complete search history.

(56) References Cited

U.S. PATENT DOCUMENTS

| | | | | | |
|---|---|---|---|---|---|
| 2,801,477 | A * | 8/1957 | Adams et al. | 40/636 |
| 2,887,792 | A * | 5/1959 | Staff | 36/100 |
| 2,948,070 | A * | 8/1960 | Lewis | 36/100 |
| 3,319,360 | A * | 5/1967 | Nadler | 36/4 |
| 3,582,993 | A * | 6/1971 | Keller | 2/74 |
| 4,461,030 | A * | 7/1984 | Knudsen | 224/222 |
| 4,516,337 | A * | 5/1985 | Adamik | 36/136 |
| 4,697,363 | A * | 10/1987 | Gamm | 36/136 |
| 4,852,276 | A * | 8/1989 | Savoca et al. | 36/136 |
| 5,501,022 | A * | 3/1996 | Cohn | 36/2 R |
| 5,659,979 | A * | 8/1997 | Sileo | 36/54 |
| 7,412,785 | B1 * | 8/2008 | Navasky | 36/100 |
| 7,421,806 | B2 * | 9/2008 | Braynock et al. | 36/100 |
| 8,176,658 | B2 * | 5/2012 | Katz | 36/100 |
| 8,413,351 | B1 * | 4/2013 | Watters et al. | 36/101 |
| D730,024 | S * | 5/2015 | McCusker-Short | D2/911 |

(Continued)

*Primary Examiner* — Khoa Huynh
*Assistant Examiner* — Megan Brandon
(74) *Attorney, Agent, or Firm* — Howison & Arnott, LLP

(57) ABSTRACT

A cowboy boot includes a front and a back shaft each having an inner lining and a cut out formed through each of the front and back shafts, a pocket formed by each of the inner linings of the front and back shafts and positioned adjacent to a cut out, the pockets configured to receive an insert therein with at least a portion of the insert exposed through the cutout and an insert received in each of the pockets with at least a portion of the insert exposed through the cut out.

1 Claim, 4 Drawing Sheets

(56) References Cited

U.S. PATENT DOCUMENTS

| | | | | |
|---|---|---|---|---|
| 2002/0046476 | A1* | 4/2002 | Snyder | 36/136 |
| 2004/0045192 | A1* | 3/2004 | Lin | 36/29 |
| 2005/0102856 | A1* | 5/2005 | Jones et al. | 36/3 R |
| 2006/0101673 | A1* | 5/2006 | Robinson et al. | 36/136 |
| 2006/0112599 | A1* | 6/2006 | Braynock et al. | 36/137 |
| 2006/0143951 | A1* | 7/2006 | Yang et al. | 36/100 |
| 2009/0199437 | A1* | 8/2009 | Pavkovic | 36/136 |
| 2010/0180469 | A1* | 7/2010 | Baucom et al. | 36/100 |
| 2010/0199521 | A1* | 8/2010 | Katz | 36/100 |
| 2012/0110873 | A1* | 5/2012 | Chen | 36/136 |
| 2012/0324764 | A1* | 12/2012 | Velez-Cruz | 36/137 |
| 2013/0031803 | A1* | 2/2013 | Koch et al. | 36/100 |
| 2013/0086819 | A1* | 4/2013 | LeGear | 36/136 |
| 2013/0133228 | A1* | 5/2013 | Nugent | 36/109 |
| 2014/0007462 | A1* | 1/2014 | Engel-Currin | 36/109 |
| 2014/0041260 | A1* | 2/2014 | Jewell et al. | 36/2 R |
| 2014/0202038 | A1* | 7/2014 | Turner | 36/100 |

* cited by examiner

COWBOY BOOTS WITH INTERCHANGEABLE INLAY FOR THE PURPOSE OF CHANGING COLORS OF DESIGN

CROSS-REFERENCE TO RELATED APPLICATIONS

This application claims benefit of U.S. Provisional Application No. 61/715,721, filed Oct. 18, 2012, entitled COWBOY BOOTS WITH INTERCHANGEABLE INLAY FOR THE PURPOSE OF CHANGING COLORS OF DESIGN, the specification of which is incorporated by reference herein in its entirety.

TECHNICAL FIELD

The invention relates to footwear and in particular to cowboy boots with decorative inserts that may be changed.

BACKGROUND

The latest cowboy boots are expensive and typically very ornate or elaborate in design, therefore limiting a wearer's ability to match multiple clothing choices with the boots. Cowboy boots are very costly, and many designs fit many styles, but consumers are limited in available colors and designs. The invention described here allows for many color and design options in a single boot, thus allowing the consumer to avoid considerable expense by purchasing one pair of boots and many inserts of different colors or patterns.

SUMMARY

In one embodiment, cowboy boot includes a front and a back shaft, each of the front and back shafts having an inner lining and a cut out formed through the front and back shafts. A pocket is formed from each of the inner linings of the front and back shafts. The pockets are each positioned adjacent to a cut out and configured to receive a colored/decorative insert therein with at least a portion of the insert exposed through the cutout. A decorative insert is received in each of the pockets with at least a portion of the colored/decorative insert exposed through the cut out.

BRIEF DESCRIPTION OF THE DRAWINGS

For a more complete understanding, reference is now made to the following description taken in conjunction with the accompanying Drawings in which.

DETAILED DESCRIPTION

Figure 1:
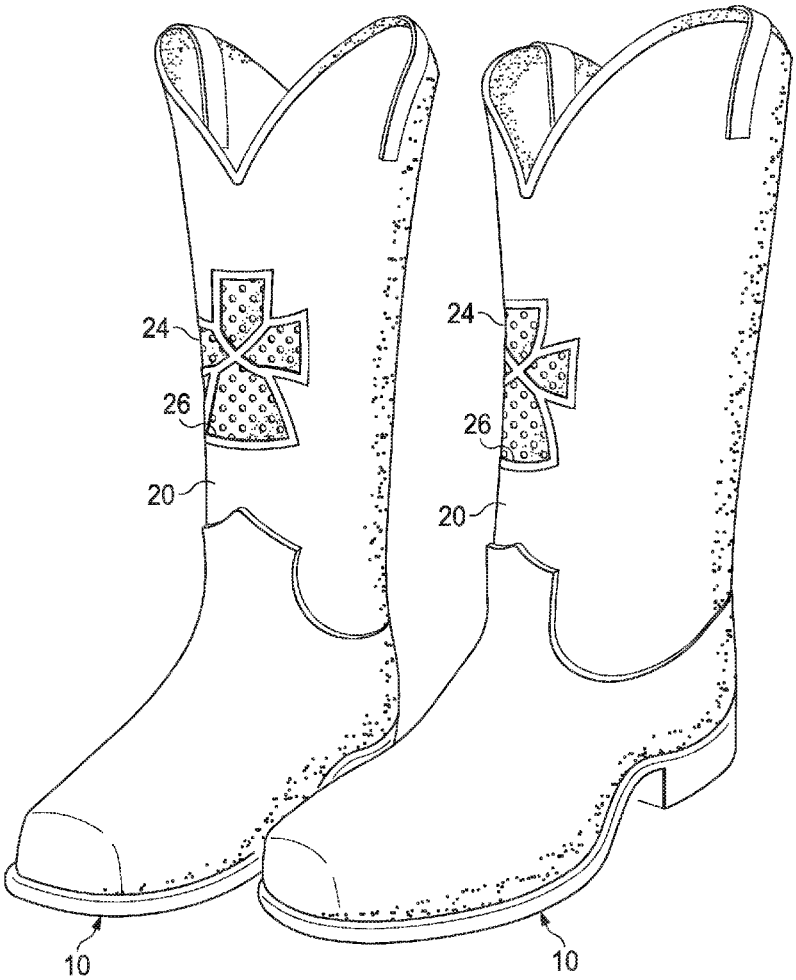
FIG. 1 is a front view of cowboy boots including inserts as described herein.
Figure 2:
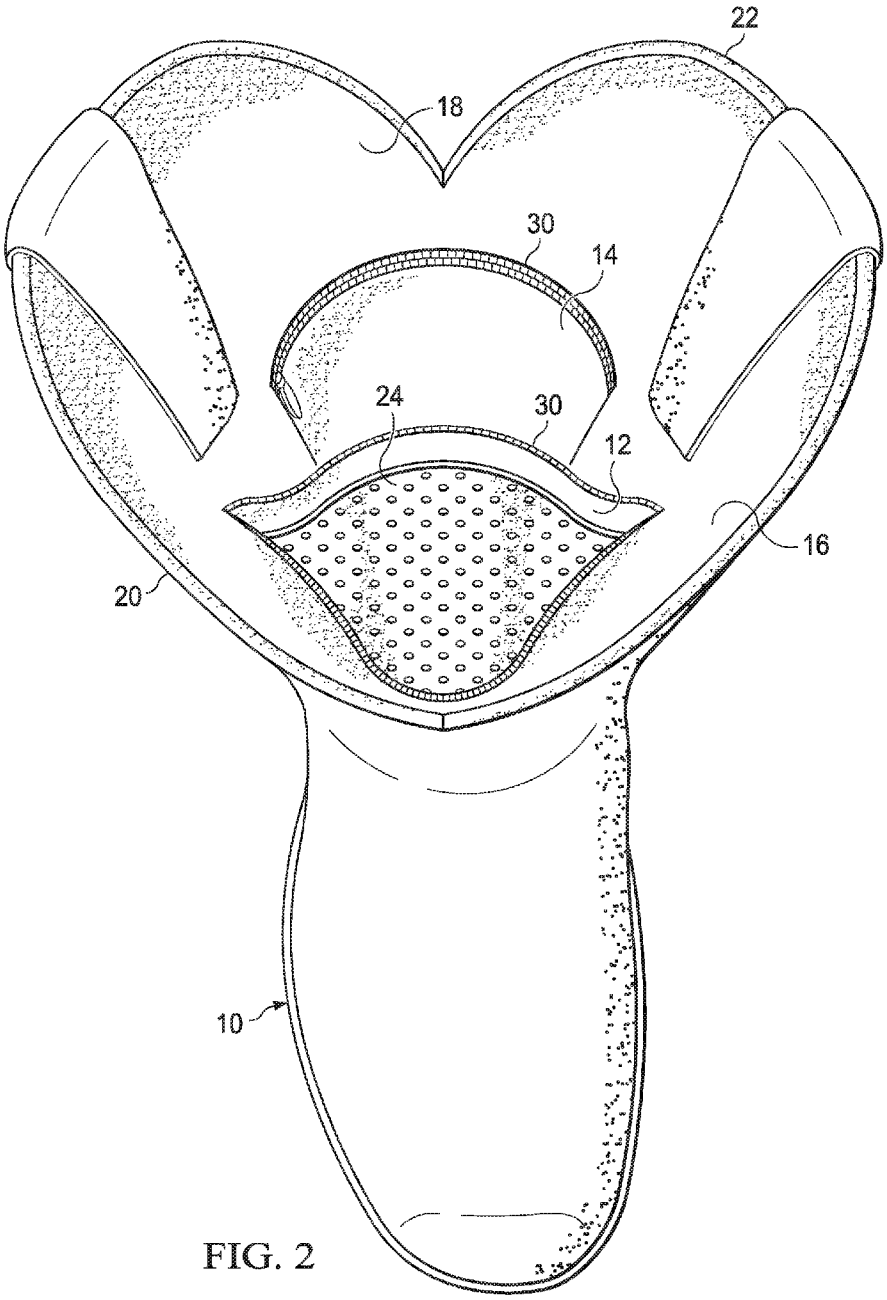
FIG. 2 is a top view of a boot of FIG. 1, illustrating a pocket formed in the inner liner of the front shaft of the boot.
Figure 3:
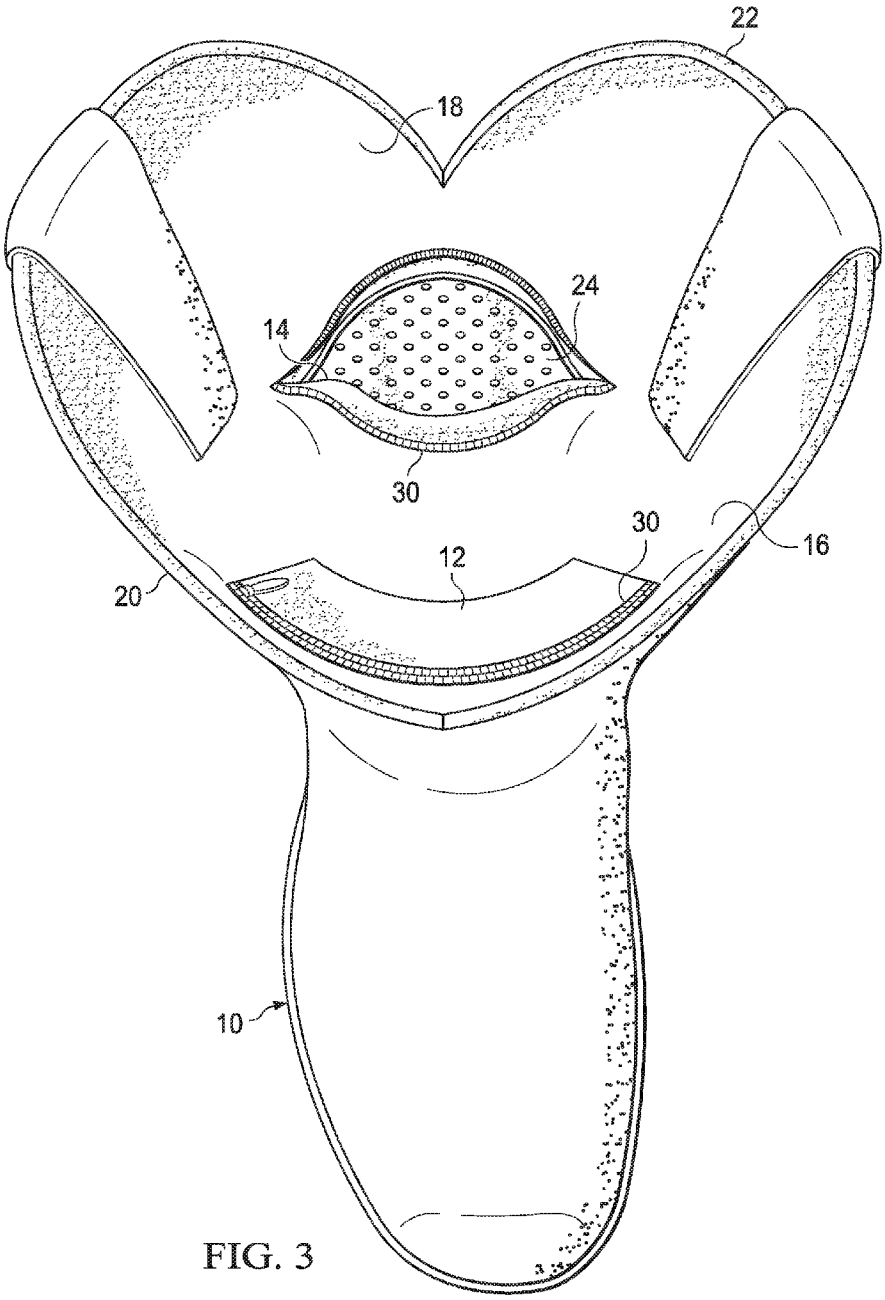
FIG. 3 is a top view of a boot of FIG. 1, illustrating a pocket formed in the inner liner of the back shaft of the boot.

Referring now to the drawings, wherein like reference numbers are used herein to designate like elements throughout, the various views and embodiments of cowboy boots with interchangeable inlay for the purpose of changing colors or design are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

As noted above, the latest trendy cowboy boots are expensive and typically very ornate or elaborate in design, therefore limiting ability to match multiple clothing choices with a given pair of boots. The invention claimed here solves this problem. Prior to the invention, cowboy boots only match certain outfits based on the color or the design of the boot. The invention provides more value for the consumer's dollar.

Referring to FIGS. 1-4, in one embodiment, zipper pockets 12, 14 are sewn into the inner lining 16, 18 of the front and back shaft 20, 22 respectively of cowboy boot 10. Pockets 12, 14 each house an insert 24 of the consumer's color/pattern choice. Inserts 24 are interchangeable to match a wearer's different outfits. The insert 24 is slid into the zipper pocket 12, 14 and fitted in the allowed space by manipulating insert 24 to fit in the provided pocket space and the zipper 30 is closed. The color/design choice insert 24 shows though the cut out 26 designs on the front and back shaft 20, 22 of boot 10. Snaps, velcro (hook and loop) or similar fasteners could be attached to the inner lining 16, 18 of the boot shaft 20, 22 to receive an insert 24, with the insert having corresponding snaps or velcro fasteners. Alternatively, an open top pocket may be used to receive an insert 24.

Figure 4:
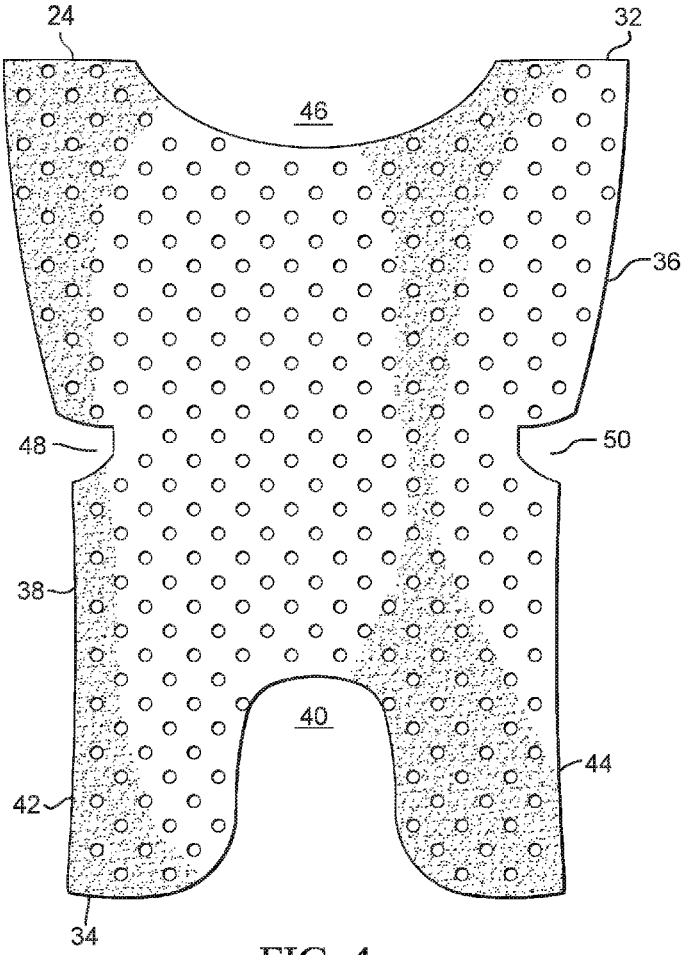
FIG. 4 is a front view of an insert configured to be received in the pocket of FIG. 2 or FIG. 3.

Referring to FIG. 4, in one embodiment, insert 24 has a generally rectangular shape with first end 32, a second end 34 and opposed generally parallel side edges 36, 38. An elongate recess 40 formed in the second end midway between the first and second side edges 36, 38 extends toward the first end to form a generally parallel pair of legs 42, 44 formed between the recess and the first and second side edges. As illustrated, a semicircular recess 46 is formed in first end 32 and a pair of notches 48, 50 are formed in each of opposing side edges 36, 38 midway between first end 32 and second end 34.

The boot making process may be outsourced to a commercial boot maker that can sew in a specific size zipper pocket 12, 14 on the inner lining 16, 18 of shaft 22, 24 of a boot. Inserts 24 may manufactured with an appropriate clicker die apparatus. The inserts 24 of the consumer's choice are slid into zipper pockets 12, 14 (front and back) and manipulated to fit in the pockets. Zippers 26 are then closed to show the color or pattern of choice.

It will be appreciated that the invention may also be used on different types of footwear, jewelry and accessories such as belts, luggage and purses.

It will be appreciated by those skilled in the art having the benefit of this disclosure that this cowboy boots with interchangeable inlay for the purpose of changing colors or design provides a convenient and inexpensive means of matching the color or design of a boot insert to match a wearer's clothing. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A cowboy boot comprising:

a shaft having a front shaft portion and a back shaft portion and an upper end, an inner lining, the inner lining extending continuously around the inside periphery of the shaft and having a front portion and a back portion corresponding to the front shaft portion and the back portion of the shaft and a cut out formed through the front shaft portion of the shaft and a cut out formed through the back shaft portion of the shaft;

a first slit formed through the front portion of the inner lining, the first slit spaced from the upper end of the shaft, a front pocket sewn from the front portion of the inner lining and the corresponding front shaft portion of the shaft, the front pocket overlying the cutout in the corresponding front shaft portion of the shaft, the first slit extending horizontally across a front portion of the inside periphery of the shaft and opening from the inside of the shaft into the front pocket and a first zipper extending along the first slit, the first zipper securing the first slit and the front pocket in a closed position;

a second slit formed through the back portion of the inner lining, the second slit spaced from the upper end of the shaft, a back pocket sewn from the back portion of the inner lining and the corresponding back shaft portion of the shaft, the back pocket overlying the cut out in the corresponding back shaft portion of the shaft, the second slit extending horizontally across a back portion of the inside periphery of the shaft and opening from the inside of the shaft into the back pocket and a second zipper extending along the second slit, the second zipper securing the second slit and the back pocket in a closed position;

a first insert received in the front pocket, the front pocket retaining the first insert with at least a portion of the first insert exposed through the cut out in the front shaft portion of the shaft and a second insert received in the back pocket, the back pocket retaining the second insert with at least a portion of the second insert exposed through the cut out in the back shaft portion of the shaft; and each of the first and the second inserts having a generally rectangular shape with first end, a second end and opposed generally parallel side edges, a recess formed in the second end midway between the first and second side edges and extending toward the first end, each of the first and the second inserts including a generally parallel pair of legs formed between the recess and the first and second side edges.

* * * * *